US006692372B1

(12) United States Patent
Colucci

(10) Patent No.: US 6,692,372 B1
(45) Date of Patent: Feb. 17, 2004

(54) PUTTER HEAD

(76) Inventor: Nicholas Colucci, 67 Bache Ave., Staten Island New York, NY (US) 10306

( * ) Notice: Subject to any disclaimer, the term of this patent is extended or adjusted under 35 U.S.C. 154(b) by 0 days.

(21) Appl. No.: 10/318,595

(22) Filed: Dec. 16, 2002

(51) Int. Cl.[7] ..... A63B 69/36; A63B 53/04

(52) U.S. Cl. ..... 473/251; 473/252; 473/328; 473/340; 473/325

(58) Field of Search ..... 473/250, 251, 473/252, 253, 254, 325, 324, 328, 340, 341, 286

(56) References Cited

U.S. PATENT DOCUMENTS 1,531,821 A * 3/1925 Scott
3,873,094 A * 3/1975 Sebo
3,955,819 A * 5/1976 Yokich
4,165,076 A * 8/1979 Cella
4,834,387 A * 5/1989 Waites
5,368,302 A * 11/1994 Thomas
5,509,658 A * 4/1996 Youngblood
5,628,696 A * 5/1997 Frye
5,630,766 A * 5/1997 Granelli
5,690,556 A * 11/1997 Condon
5,928,088 A * 7/1999 Matthews
6,520,865 B1 * 2/2003 Fioretti

* cited by examiner

*Primary Examiner*—Sebastiano Passaniti

(57) ABSTRACT

A putter head with two thin rails that extend from the back of the putter face to the rear of the putter head on the bottom of the putter head. The two thin rails reduce resistance from the turf during putting, assist a golfer to position the putter head, position the golfers head at address and pick up a golf ball form the turf or out of a golf hole. The two striking faces, one front striking face is for normal use and the other smaller striking in the back of the putter head is for practice or hitting a golf ball left handed. The three long plastic insert sighting lines on a flat surface, one thin and the other two dimensioned wider to assist a golfer to line up with the intended target while putting.

3 Claims, 1 Drawing Sheet

PUTTER HEAD

BACKGROUND OF THE INVENTION

Field of the Invention

The putter head is a part of a golf club called a putter, which consists of a head, shaft, and a grip. My invention is the head.

DESCRIPTION OF THE PRIOR ART

Some putters have short sighting lines that offer little or no assistance to a golfer and the golfers lines up the face of the putter head with their target. The heads don't have three long inserted sighting lines, one dimensioned thin and two wide lines on a flat surface on top of the putter head that extend from the face of the putter head to the rear of the putter head.

The contrasting colored three long sighting lines on my putter head are used to line up the putter head with the target which is more accurate then lining up the face of the putter head. The center sighting line is in the center of the putter head and is inline with the sweet spot of the putter face.

The bottoms of the prior art have a lot of mass on the bottom of the putter head, which offers resistance from the turf.

My invention has a cavity bottom with two thin parallel rails that extends rearward from the back of the putter blade to the rear of the putter head. The cavity bottom reduces resistance from the turf. The outside of the two rails assist a golfer to position his head over a golf ball at address for a proper putting stance. The inside of the two rails has an area ½ inch from the rear of the putter blade, 3⁄16 of an inch wide, 3⁄16 of an inch from the bottom of the putter head and 11⁄4 inches rearward with a rough or sand blast finish. The inside dimension between the two rails is slightly smaller than the diameter of a golf ball and can pick up a golf ball. No putter has two parallel outside surfaces of the putter head that can be used to help position a golfer in a proper putting stance.

SUMMARY OF INVENTION

My invention is a putter head to make putting easier by providing a putter with a cavity bottom that consists of two rails. The two rails offer less resistance from turf and the outside of the two rails assist a golfer to position his head over a golf ball at address. The two rails are parallel, perpendicular to the face of the putter head, an area ½ inch from the back of the putter head blade, 3⁄16 of an inch from the bottom of the putter head, 1¼ of an inch rearward, with a sand blast finish. The two rails are spaced apart slightly smaller than a golf ball to allow a golf ball to be wedged between the two rails to pick up a golf ball. The perimeter dimension of the putter head is small enough to fit in a golf hole to pick the golf ball out of a cup or whenever a golfer wishes to pick up a golf ball.

This putter head has three long inserted sighting lines in the center and on top of the putter head. Two wide white lines and a small center red line. The sighting lines can be of other contrasting colors on the flat surface on the top of the putter head. The sighting lines extend from the face of the putter head rearward to the back of the putter head. The center sighting line is inline with the sweet spot of the putter head. The sighting lines are to line up the putter head with a target for accuracy.

In addition to the main putter striking face, this putter head has a small striking face in the back of the putter head that is parallel to the main striking face. This small face can be used to practice putting. While practicing putting a golfer places a golf ball behind the putter head and hits the ball with the backstroke. If the golf ball rolls straight back it indicates that the golfers backstroke is straight back. The small striking face can be used to hit a golf ball left handed.

DESCRIPTION OF THE DRAWING

Figure 1:
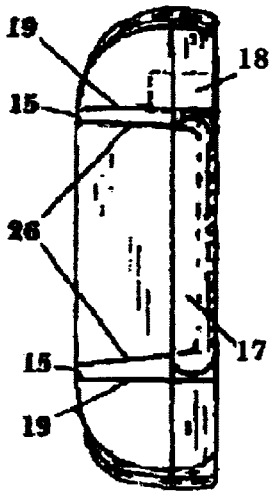
FIG. 1, is the back view of the putter head.

FIG. 1, is the back view of the putter head showing the two-rail (15), the small striking face (17), the inside of the rails (26), the outside of the rails (19), and the base of the cavity bottom (27).

Figure 2:
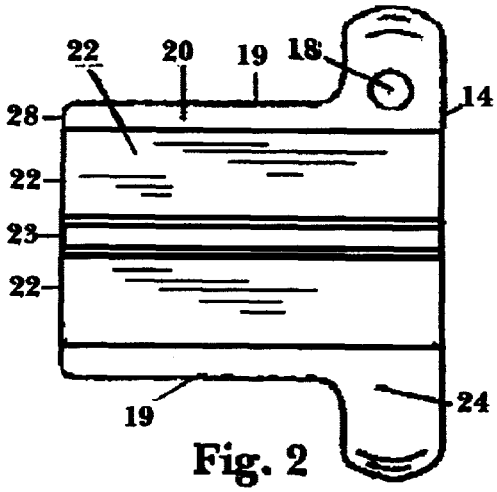
FIG. 2, is the top view of the putter head.

FIG. 2, is the top view of the putter head (24). The material used to make the body (20) of the putter head can be of a variety of metals commonly used in the manufacture of putter heads. Both sides of the center of the putter head are scientifically balanced. Two wide white lines (22) are present. One thin red line (23) in the center of the putter head is inline with the sweet spot. The three long sighting lines are plastic inserts on a flat surface that extends from the front striking face (14) of the putter head to the rear of the putter head (28). The inserts may be other contrasting colors.

The hole (18) has a compound angle with relation to the top of the putter head (24). The hole is to insert a double bent shaft for a right handed golfer. The hole (18) can be placed in the opposite side of the putter head for a left-handed golfer.

The body (20) has two faces. The main striking face (14) is for normal use. The small striking face (17) on the rear of the putter head is for practice or to hit a golf ball left handed.

The outside of the rails (19) are parallel and will assist a golfer to position his head over the golf ball at address.

Figure 3:
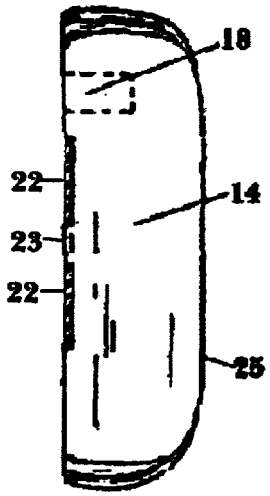
FIG. 3, is the front view of the putter head.

FIG. 3, shows the front views. The main striking face of the putter head is (14). The hole is (18). The bottom of the face is (25). The top of the putter head is (24). The wide plastic inserts are (22). The thin plastic center insert is (23)

Figure 4:
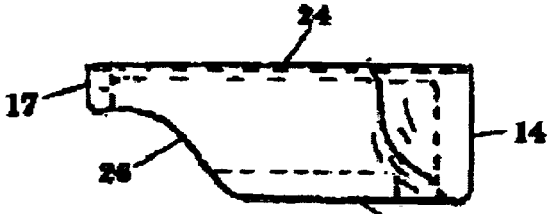
FIG. 4, is the side view of the putter head.

FIG. 4, shows the side view of the putter heads. The top of the putter head (24) and the bottom of the putter head (25) are parallel. The base of the cavity bottom is (27). The rough or sand blast area is (16). The small striking face in the rear of the putter head is (17). The shape of the rails (26) is shown.

Figure 5:
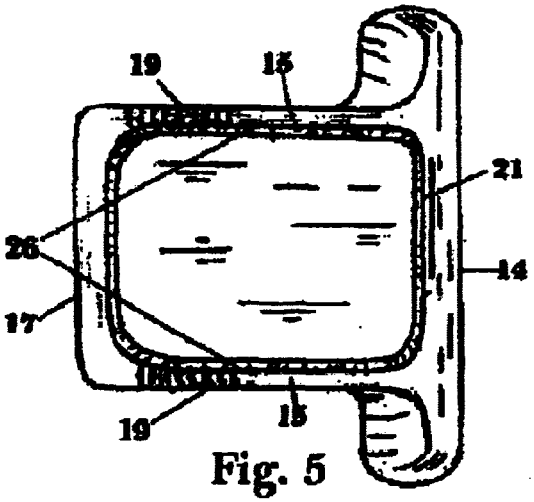
FIG. 5, is the bottom view of the putter head.

FIG. 5, shows bottom view showing the shape of the cavity bottom in the putter head. The main striking face is (14). The small striking face in the rear of the putter head is (17). The rails are (15). The outside of the rails are (19). The inside of the rails is (26). The back of the main striking face is (21).

Figure 6:
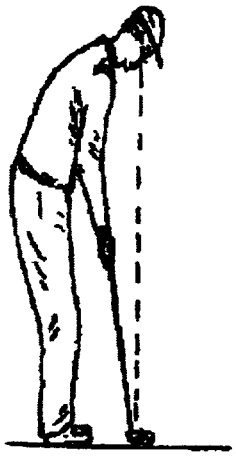
FIG. 6, is not a part of my invention. It is a sketch of a golfer in a proper putting stance with his eyes directly over the golf ball.

FIG. 6, a sketch of a golfer in a proper putting stance with his eyes directly over the putter head to show the advantages of the outside of the rails (19). shown in FIG. 2 and FIG. 5.

If the golfer can see the outside wall (19) the golfer should adjust his stance.

Figure 7:
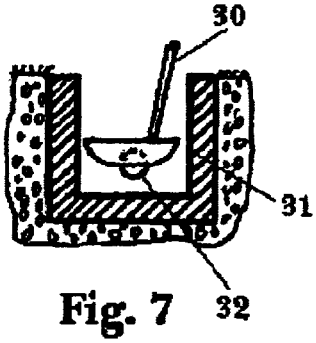
FIG. 7 the golf ball, shaft and golf hole are not part of my invention. The figure shows that the putter head will fit into a golf hole and pick the golf ball out of the golf hole.

FIG. 7, is a partial cross-section view illustrating the putter head invention affixed to a golf ball within a golf cup. (30) is a putter shaft, (31) is a golf cup, (32) is a golf ball, are not part of my invention; they are to show that the putter head is dimensioned to fit into a golf cup.

DETAILED DESCRIPTION OF THE INVENTION

FIG. 2, shows three long plastic insert sighting lines on the top of the putter head (24), two are dimensioned wide lines (22) and one thin line (23) in the center of the putter head. The center line (23) is in line with the sweet spot of the putter head on a flat surface. The three long sighting lines are to assist a golfer to line up the putter head with golfers intended target. While practice swinging and looking at the sighting lines the golfer can see if the putter head is going straight back and straight through. The long plastic insert sighting lines can be made of contrasting colors. I recommend that the two wide inserts (22) to be white and the thin center line (23) red.

The cavity bottom offers less resistance from the turf while putting and with it's peripheral balance gives the putter a good feel for consistent putting. The two rails (15) are parallel, perpendicular to the putter face (14) and extend 1¾ inches from the rear of the putter face (21) towards the back of the putter head. The distance between the inside of the two parallel rails (15) is slightly smaller than a golf ball and the area (16) ½ inch from the back of the face (21), 3⁄16 of an inch from the bottom of the rails (25) and 1¼ rearward, with a rough or a sand blast finish that will hold a golf ball.

The putter head has a perimeter dimensioned to enable the putter head to fit within a golf hole and can pick up a golf ball out of a golf hole or whenever necessary to save bending.

This putter head has two striking faces to hit a golf ball, the front striking face (14) is for normal use and a small striking face (17) in the rear of the putter head is for practice. While practicing putting, a golf ball is placed behind the putter head and the golf ball is struck with the golfers backstroke. If the golf ball roles straight back, this shows the golfer that the backstroke was straight back. The small striking back face in the back of the putter head (17) can be used to hit a golf ball left handed. The hole (18) is for a double bent shaft and has a compound angle with relation to the top of the putter head. The hole (18) can be placed in the opposite side of the putter head for a left-handed golfer.

FIG. 6, illustrates putting stroke that is easier to go straight back and straight through to the target the golfer's head should be directly over the golf ball. If the golf is in a proper putting stance to hit a golf ball, with his head over the golf ball, the golfer will not see the outer surface of the rails (19). If the golfer can see one side of a rail (19), the golfer should adjust his or her putting stance.

FIG. 7, is a partial cross-section view illustrating the putter head invention affixed to a golf ball within a golf cup. (30) is a putter shaft, (31) is a golf cup, and (32) is a golf ball and are not part of my invention. Here, it is shown that the putter head is dimensioned to fit into a golf cup.

I claim:

1. A putter head for assisting a golfer to position his head over a golf ball at address for a proper stance while putting and for allowing a golf ball to be picked up from the turf or from within a golf hole, said putter head comprising:

a putter head body having a front striking face, a back striking face, a rear, a top and a bottom: the putter head having a perimeter dimensioned small enough for enabling the putter head to fit within a golf hole;

two thin rails for supporting the putter head while addressing a golf ball; said rails oriented perpendicular to a plane containing the putter face and extending from the back of the putter face to the rear of the putter head; the bottom of the rails oriented parallel to one another for reducing resistance from the turf during putting; the spacing between inside portions of the two rails dimensioned to be slightly smaller than a golf ball;

said putter head body being provided with a rough or sand blast finish that extends on a portion of the surface area of both the bottom of the putter head and the inside portion of the rails; the rough or sand blast finish being generally ½ inch behind the back of the putter face and 3⁄16 inch from the bottom of the rails and extending rearward towards the rear of the putter head for a distance equal to substantially 1¼ inches; whereby, a golf ball may become wedged between the two parallel rails and the putter head body to allow the bottom of the putter head to pick up the golf ball.

2. A putter head according to claim 1, wherein the back striking face is located opposite the front striking face at the rear of the putter head.

3. A putter head according to claim 1, wherein the putter head body includes a flat surface on the top of the putter head; said flat surface further includes three sighting lines of contrasting colors extending from the face of the putter head to the rear of the putter head; two of the said sighting lines being dimensioned wider than a third of sighting lines, with said third sighting line positioned substantially in the center of the top of the putter head, whereby the sighting lines assist a golfer with lining up the putter head and an intended target.

* * * * *